US008646945B2

(12) United States Patent
Wu

(10) Patent No.: US 8,646,945 B2
(45) Date of Patent: Feb. 11, 2014

(54) WATERPROOF OUTDOOR LIGHTING FIXTURE

(75) Inventor: Meng-Hsiu Wu, Taoyuan Hsien (TW)

(73) Assignee: Exito Electronics Co., Ltd., Taoyuan Hsien (TW)

( * ) Notice: Subject to any disclaimer, the term of this patent is extended or adjusted under 35 U.S.C. 154(b) by 128 days.

(21) Appl. No.: 13/432,972

(22) Filed: Mar. 28, 2012

(65) Prior Publication Data

US 2013/0258681 A1 Oct. 3, 2013

(51) Int. Cl.
*F21V 29/00* (2006.01)

(52) U.S. Cl.
USPC ..... 362/267; 362/374; 362/645

(58) Field of Classification Search
USPC ..... 362/267, 318.11, 374, 645
See application file for complete search history.

(56) References Cited

U.S. PATENT DOCUMENTS 2,225,816 A * 12/1940 Anklam ..... 362/267
4,100,448 A * 7/1978 Chipner et al. ..... 313/318.11
4,660,916 A * 4/1987 Williams, Jr. ..... 439/271

* cited by examiner

*Primary Examiner* — Stephen F Husar

(57) ABSTRACT

A waterproof outdoor lighting fixture includes a lamp holder having a front lamp bulb socket for receiving a lamp bulb, an outer shell molded on the periphery of the lamp holder and having locating holes located on an inner wall of a lampshade portion thereof, a waterproof gasket tightly press-fitted into the lampshade portion of the outer shell, and an annular locating member fastened to the lampshade portion of the outer shell to lock the waterproof gasket.

6 Claims, 9 Drawing Sheets

WATERPROOF OUTDOOR LIGHTING FIXTURE

BACKGROUND OF THE INVENTION

1. Field of the Invention

The present invention relates to lighting fixture technology and more particularly, to a waterproof outdoor lighting fixture which uses a locating member to lock a waterproof gasket to a lamp holder, avoiding falling of the waterproof gasket during replacement of the lamp bulb.

2. Description of the Related Art

In consideration of numerous factors, such as creating a special atmosphere or for allowing more people to participate, banquet, toastmasters, night market trafficking and many other activities may be held at night. In a night garden, landscape place, or any place for night activities, lighting is quite important. When installing an outdoor lighting fixture, the waterproof measure must be taken into account to avoid an electrical leakage.

To seal the gap between the lamp bulb and lamp socket of an outdoor lighting fixture against water or moisture, a waterproof gasket is usually used. However, when replacing the lamp bulb of an outdoor lighting fixture, the waterproof gasket will be moved out of the lampshade, and the user may forget to put the waterproof gasket back into the inside of the lampshade, resulting in waterproof failure.

SUMMARY OF THE INVENTION

The present invention has been accomplished under the circumstances in view. It is the main object of the present invention to provide a waterproof outdoor lighting fixture which uses a locating member to lock a waterproof gasket to a lamp holder, avoiding falling of the waterproof gasket during replacement of the lamp bulb and effectively sealing the lamp holder against outside moisture.

To achieve this and other objects of the present invention, a waterproof outdoor lighting fixture comprises a lamp holder having a front lamp bulb socket for receiving a lamp bulb, an outer shell molded on the periphery of the lamp holder and having locating holes located on an inner wall of a lampshade portion thereof, a waterproof gasket tightly press-fitted into the lampshade portion of the outer shell, and an annular locating member fastened to the lampshade portion of the outer shell to lock the waterproof gasket.

DETAILED DESCRIPTION OF THE PREFERRED EMBODIMENT

Figure 1:
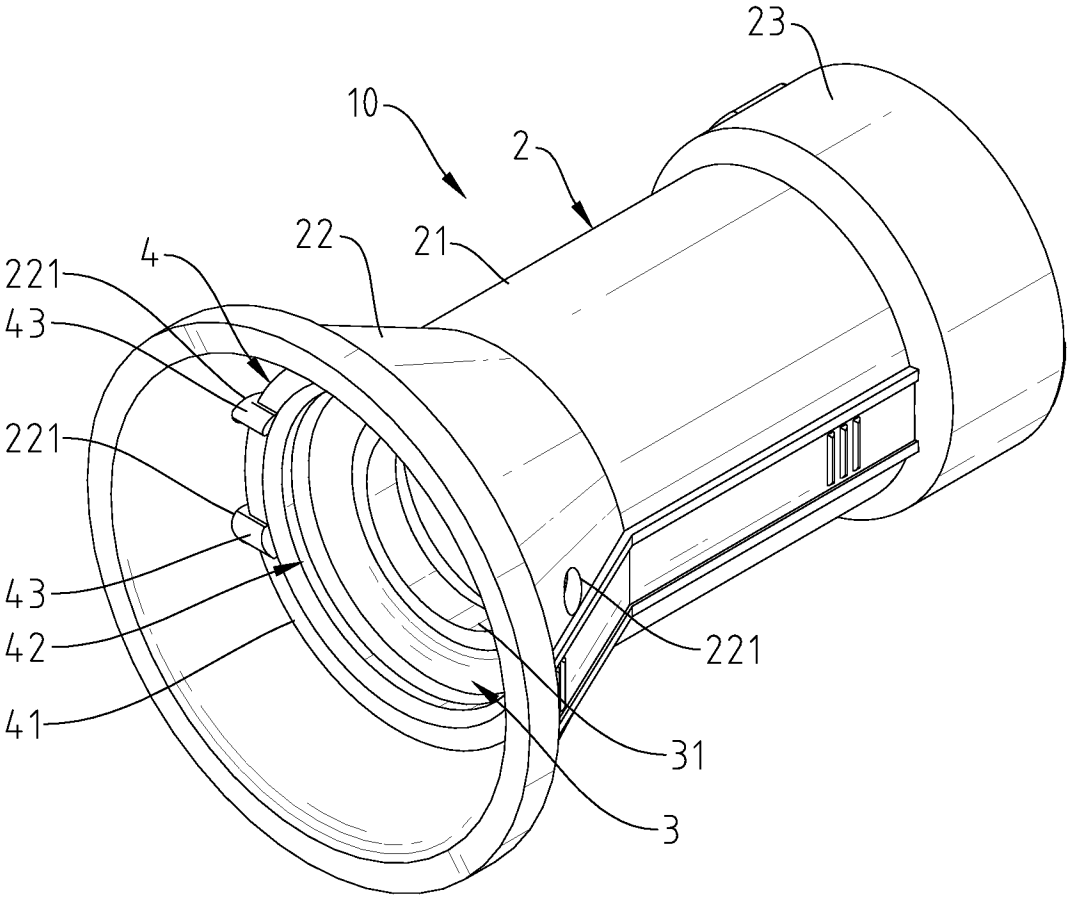
FIG. 1 is an oblique elevation of a waterproof outdoor lighting fixture in accordance with the present invention (power cable excluded).
Figure 2:
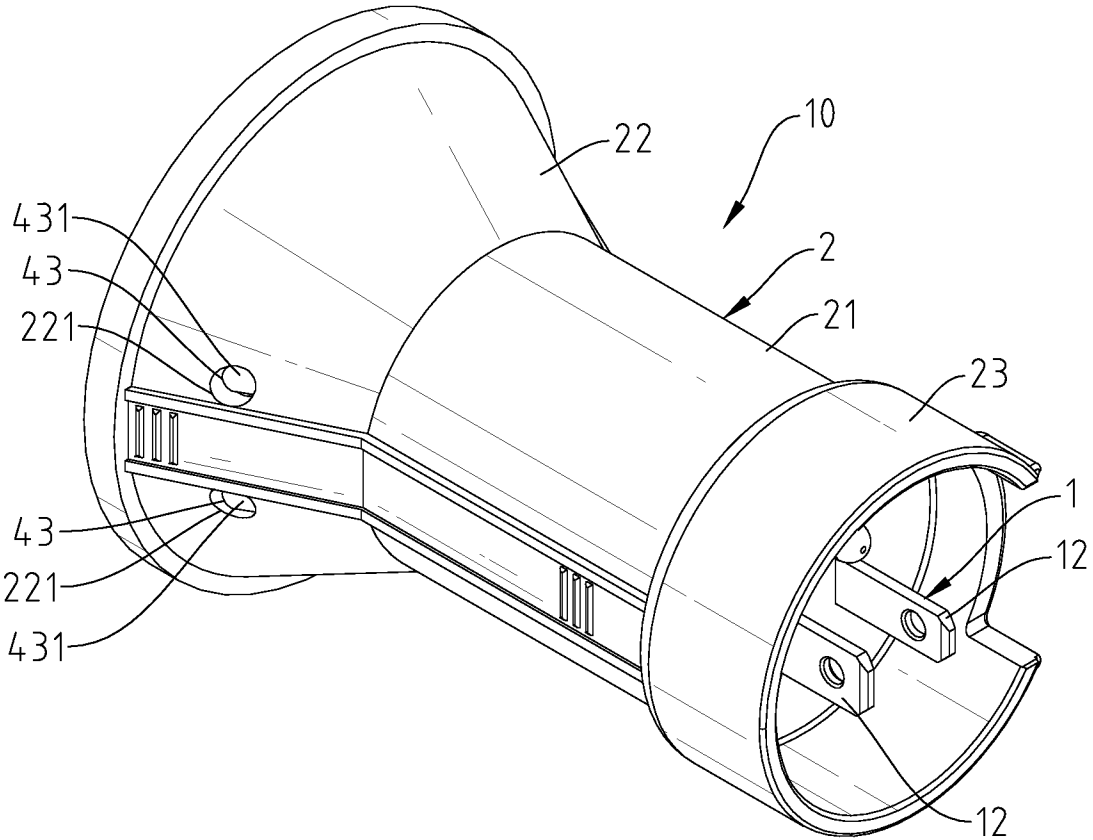
FIG. 2 corresponds to FIG. 1 when viewed from another angle.
Figure 3:
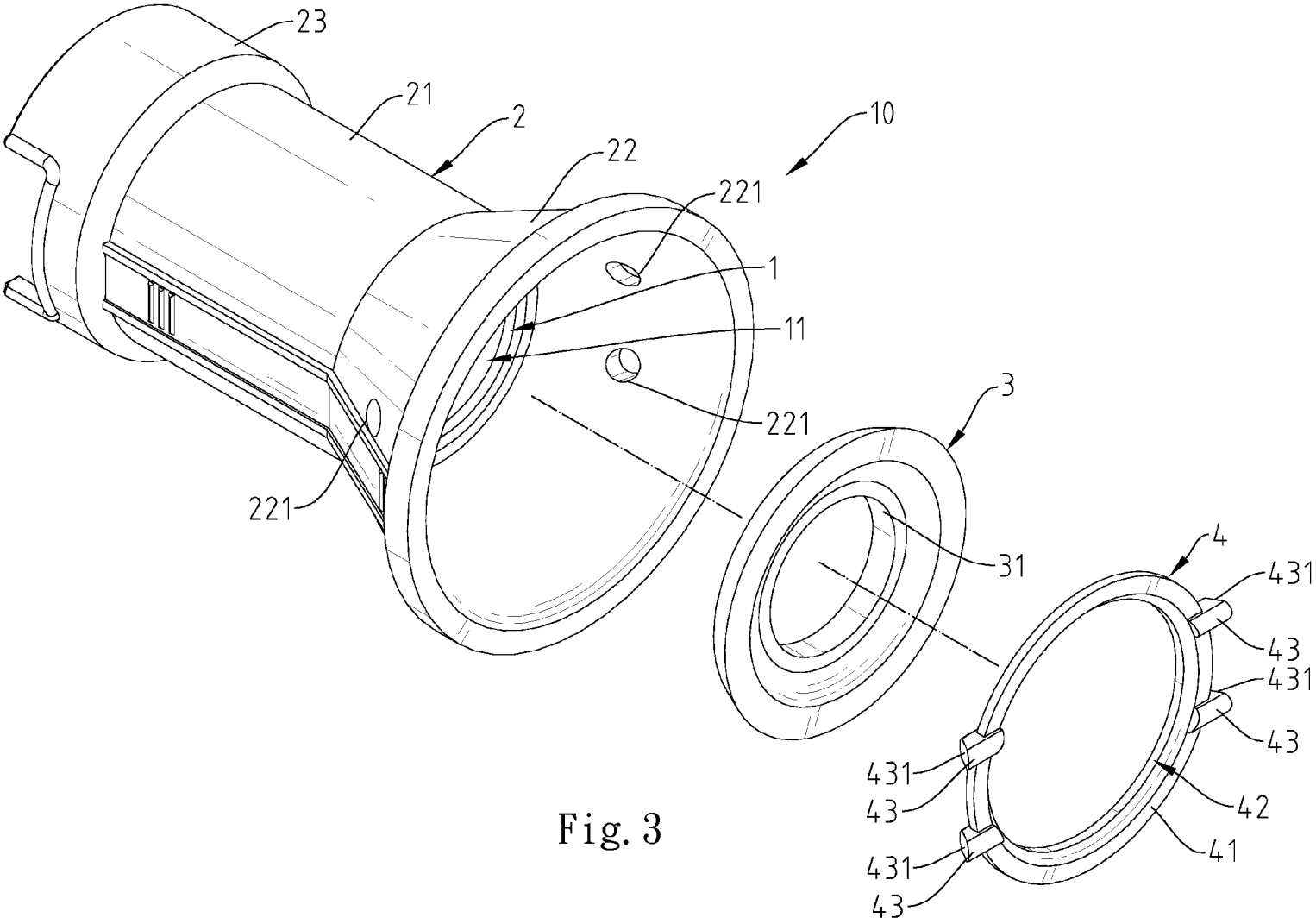
FIG. 3 is an exploded view of the waterproof outdoor lighting fixture in accordance with the present invention (power cable excluded).
Figure 4:
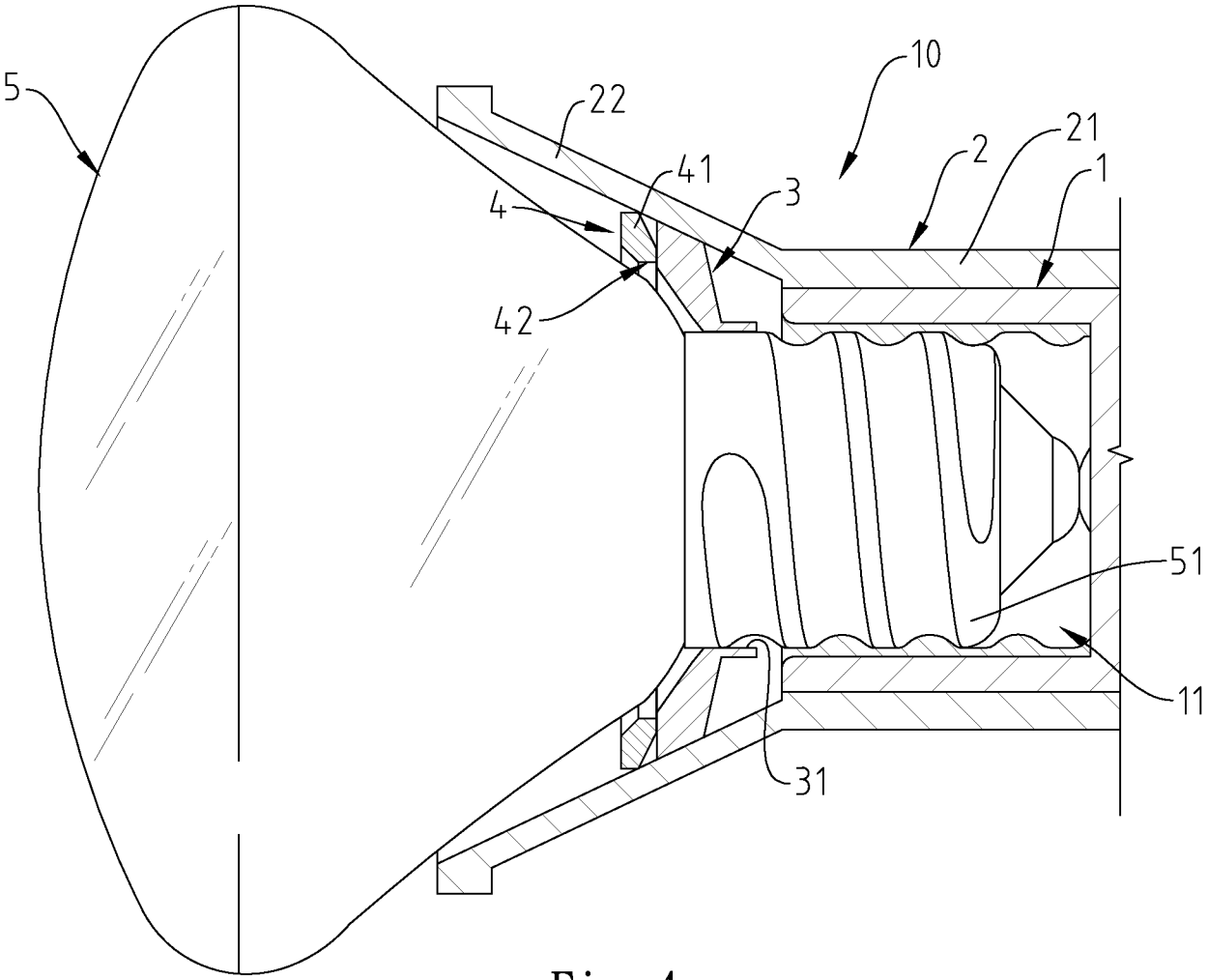
FIG. 4 is a sectional view of the present invention, illustrating a lamp bulb installed in the front lamp bulb socket of the lamp holder.

Referring to FIGS. 1-4, a waterproof outdoor lighting fixture 10 in accordance with the present invention is shown comprising a lamp holder 1, an outer shell 2, a waterproof gasket 3, and a locating plate 4.

The lamp holder 1 comprises a front lamp bulb socket 11, and a plurality of electrode plates 12 backwardly extended from the rear side of the front lamp bulb socket 11 in a parallel manner.

The outer shell 2 molded on the periphery of the lamp holder 1, comprising a body portion 21 surrounding the lamp holder 1, a lampshade portion 22 forwardly extended from the front end of the body portion 21 and shaped like a horn, a plurality of locating holes 221 located on the inner wall of the lampshade portion 22, and a tubular rear guard portion 23 backwardly extended from the rear end of the body portion 21 and spaced around the electrode plates 12 of the lamp holder 1.

The waterproof gasket 3 has a center hole 31 cut through opposite front and back sides thereof at the center. Further, the periphery of the waterproof gasket 3 is tapered, fitting the inner wall of the lampshade portion 22. Further, the waterproof gasket 3 is made of an elastically deformable material, for example, rubber.

The locating member 4 comprises an annular base 41, a center opening 42 surrounded by the annular base 41, and a plurality of locating rods 43 transversely outwardly extended from the annular base 41 corresponding to the locating holes 221 of the outer shell 2. Each locating rod 43 has a beveled guide face 431.

During installation of the waterproof outdoor lighting fixture 10, insert the waterproof gasket 3 into the lampshade portion 22 of the outer shell 2, and then insert the locating plate 4 into the lampshade portion 22 of the outer shell 2 to stop the waterproof gasket 3 against the front end of the lamp holder 1 and to force the locating rods 43 of the locating plate 4 into the respective locating holes 221 of the outer shell 2. By means of the beveled guide faces 431 and elastically deformable material property of the locating plate 4, the locating rods 43 of the locating plate 4 can easily be forced into respective locating holes 221 of the outer shell 2. When assembled, the waterproof gasket 3 is tightly squeezed between the lamp holder 1 and the locating plate 4.

Figure 5:
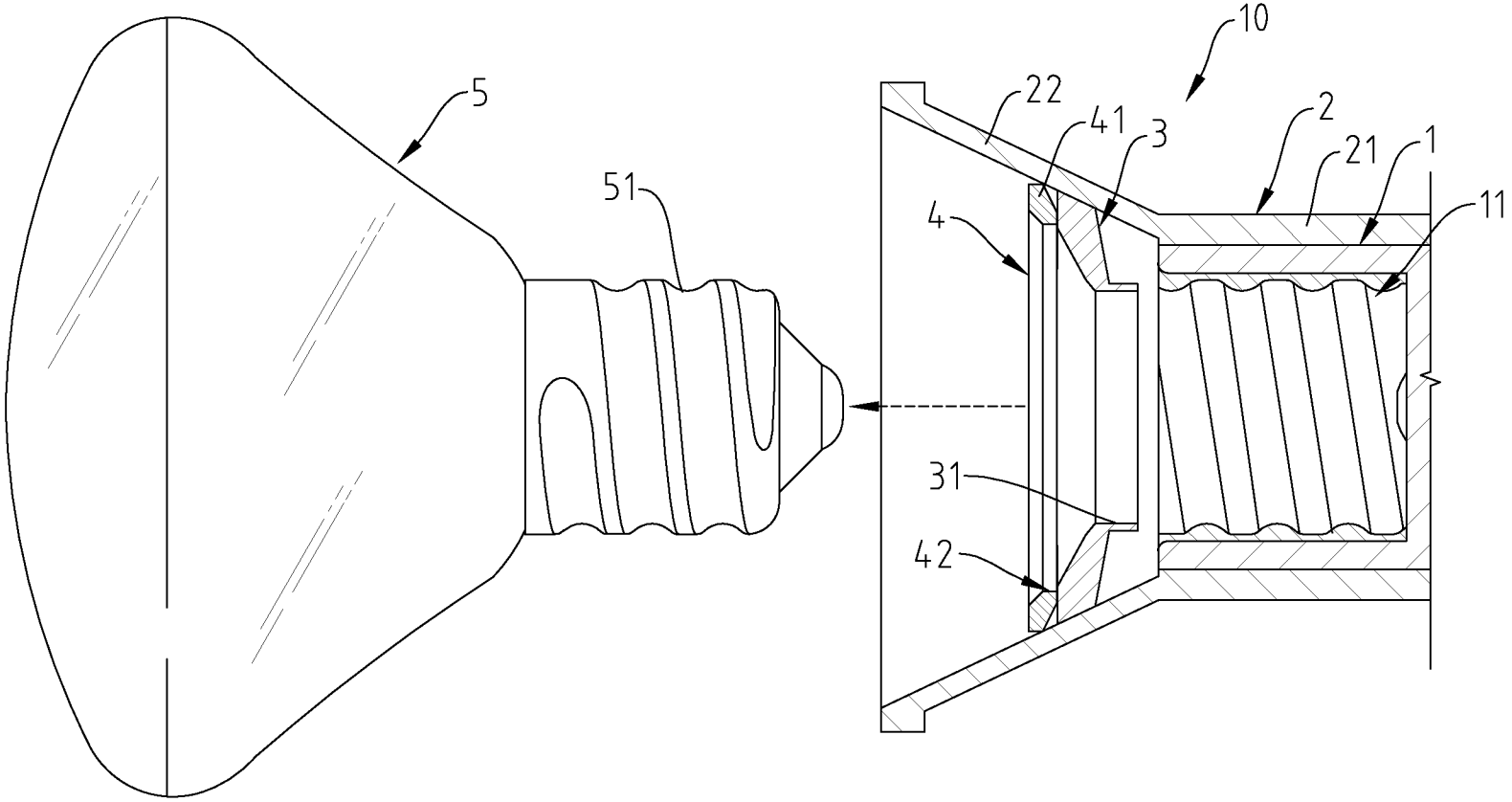
FIG. 5 corresponds to FIG. 4, illustrating the lamp bulb separated from the waterproof outdoor lighting fixture.
Figure 6:
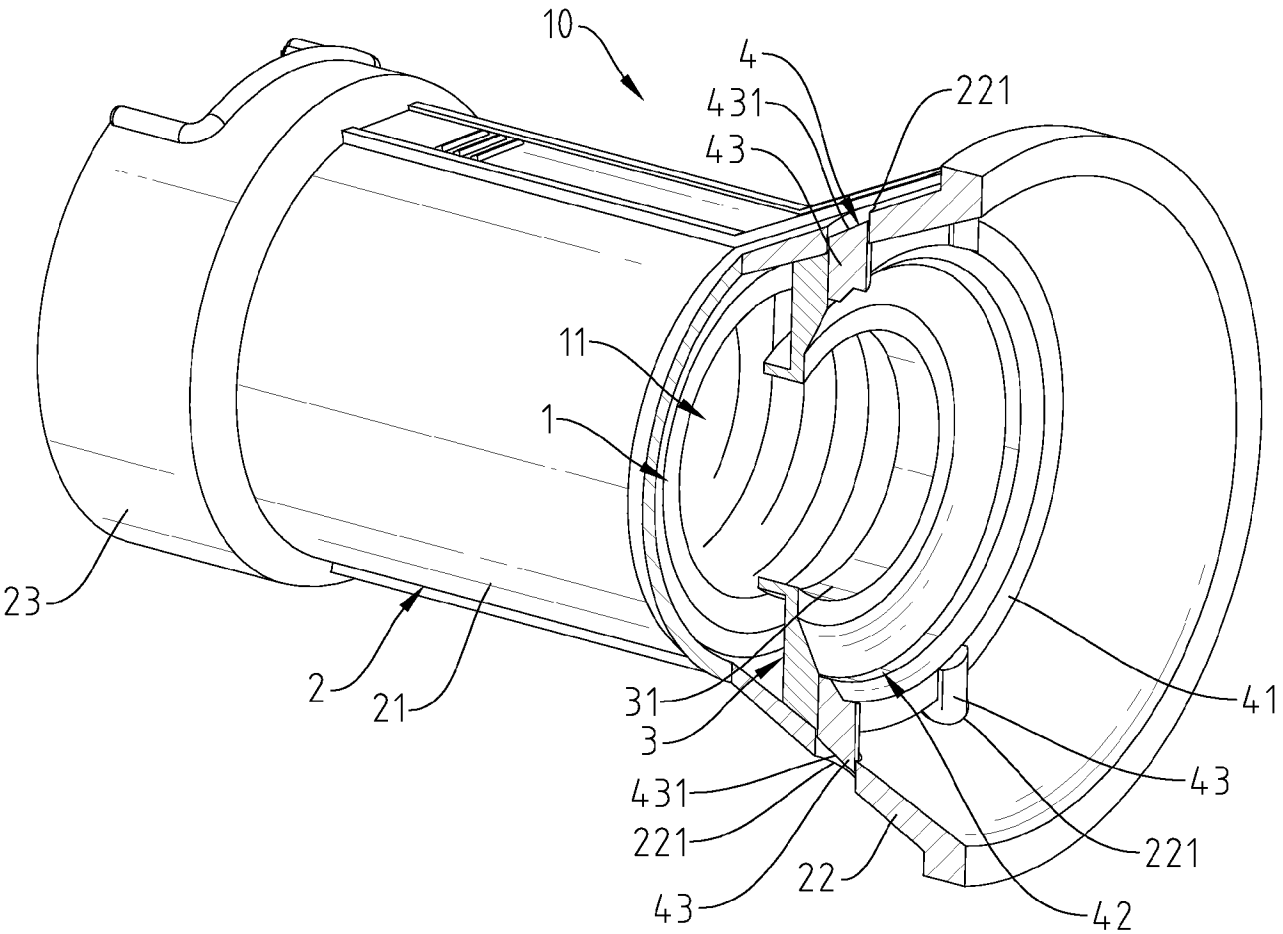
FIG. 6 is a sectional elevation of the waterproof outdoor lighting fixture in accordance with the present invention.

Referring to FIG. 5 and FIGS. 3 and 4 again, when installing a lamp bulb 5 in the waterproof outdoor lighting fixture 10, insert the cap (sleeve) 51 of the lamp bulb 5 through the center opening 42 of the locating plate 4 and the center hole 31 of the waterproof gasket 3, and then thread the cap (sleeve) 51 of the lamp bulb 5 into the front lamp bulb socket 11 of the lamp holder 1, thereby electrically connecting the lamp bulb 5 and the front lamp bulb socket 11 of the lamp holder 1 together. Further, the diameter of the center hole 31 of the waterproof gasket 3 is slightly smaller than the outer diameter of the cap (sleeve) 51 of the lamp bulb 5. After installation of the lamp bulb 5 in the front lamp bulb socket 11 of the lamp holder 1, the waterproof gasket 3 is kept in engagement with the periphery of the top end of the cap (sleeve) 51 of the lamp bulb 5 and forced by the lamp bulb 5 against the inner wall of the lampshade portion 22 of the outer shell 2, effectively seals the lamp holder 1 against outside moisture. Further, when going to remove the lamp bulb 5 from the waterproof outdoor lighting fixture 10 for a replacement, rotate the lamp bulb 5 relative to the lamp holder 1 in the reversed direction. When rotating the lamp bulb 5 out of the lamp holder 1, the lamp bulb 5 will impart an outwardly pulling force to the waterproof gasket 3. As this time, the waterproof gasket 3 is prohibited from outward movement by the annular base 41 of the locating plate 4, and therefore the cap (sleeve) 51 of the lamp bulb 5 can be smoothly removed from the lamp holder 1 and the waterproof gasket 3.

Figure 7:
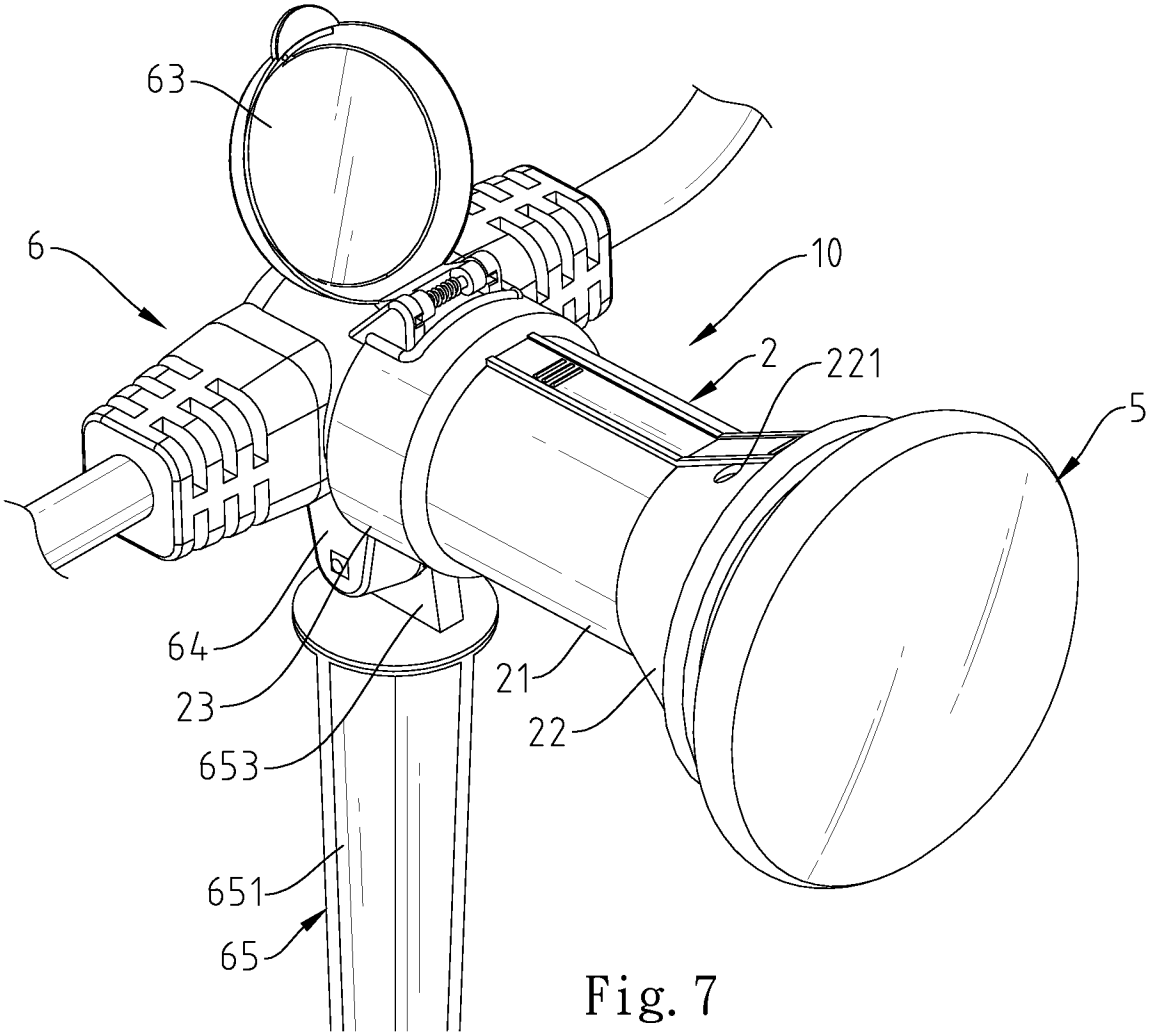
FIG. 7 is a schematic applied view of the present invention (I).
Figure 8:
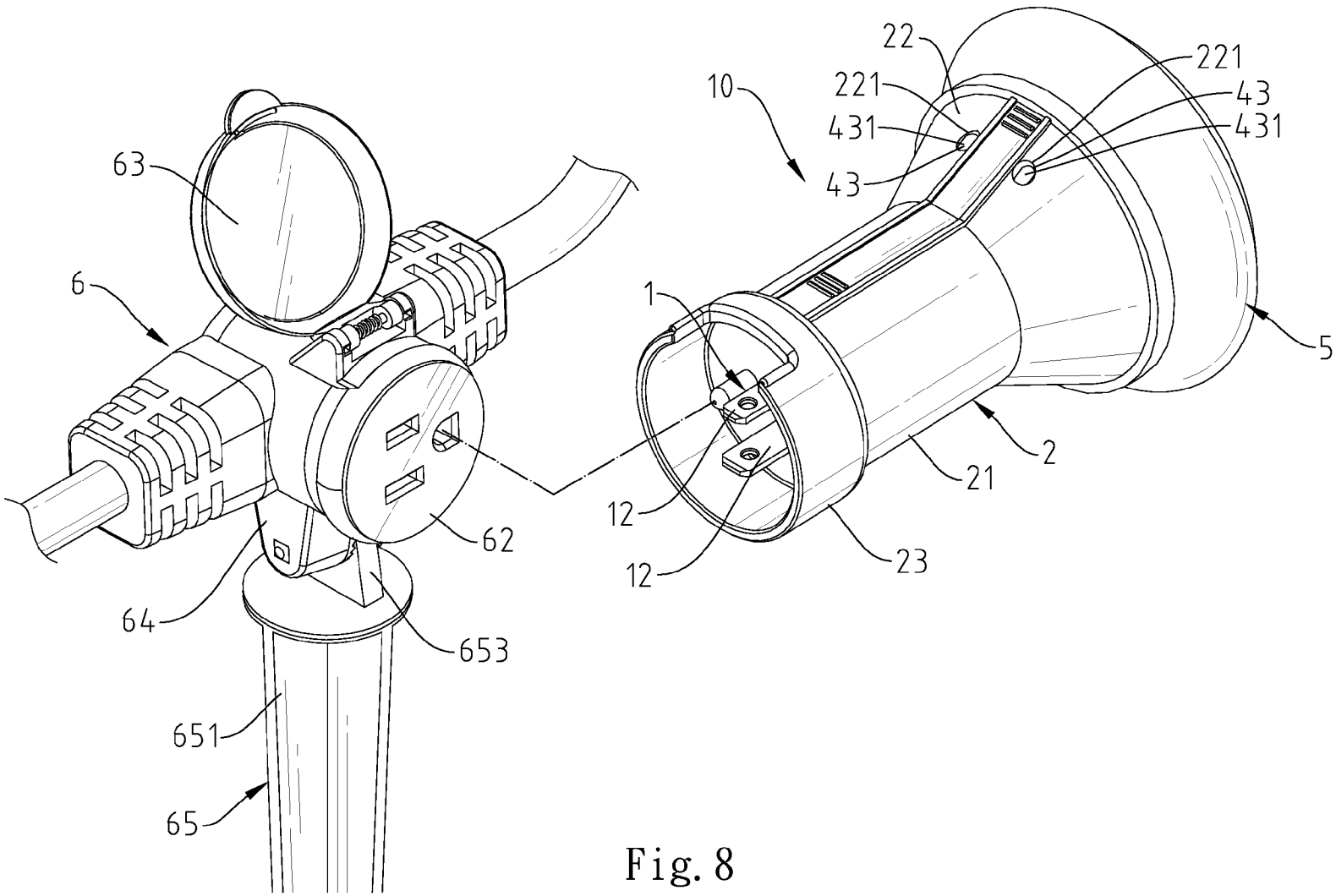
FIG. 8 is a schematic applied view of the present invention (II).
Figure 9:
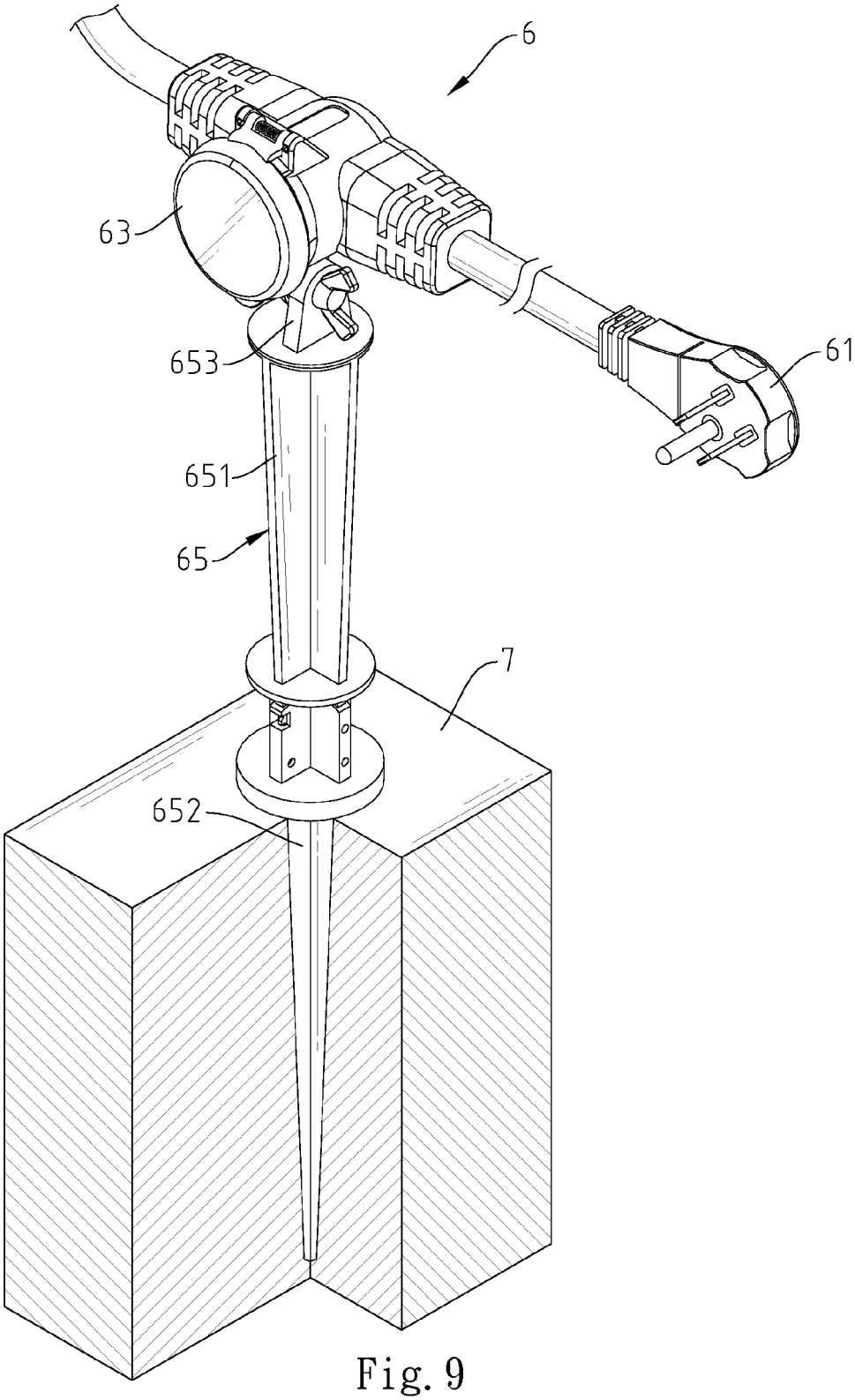
FIG. 9 is a schematic applied view of the present invention (III).

Referring to FIGS. 7-9, the waterproof outdoor lighting fixture 10 further comprises a power cable 6. The power cable 6 comprises an electrical plug 61 located on one end thereof for connection to an electrical outlet, an electrical socket 62, a hinged seal cap 63 for closing the electrical socket 62 in a watertight manner, a connection block 64 located on the bottom side of the electrical socket 62, and an anchor member 65 connected to the connection block 64 for anchoring. The anchor member 65 comprises a shank 651, a pointed pin 652 axially extended from one end of the shank 651 for fastening to the ground 7, and a connector 653 located on the other end of the shank 651 and pivotally adjustably connected to the connection block 64.

When using the waterproof outdoor lighting fixture 10, connect the electrical plug 61 of the power cable 6 to an electrical outlet or power supply device, and then fasten the pointed pin 652 of the anchor member 65 to the ground 7, and then open the hinged seal cap 63 from the electrical socket 62, and then insert the electrode plates 12 of the lamp holder 1 into the electrical socket 62 to force the tubular rear guard portion 23 onto the periphery of the electrical socket 62 tightly, prohibiting outside water or moisture from entering the inside of the waterproof outdoor lighting fixture 10.

In conclusion, the invention provides a waterproof outdoor lighting fixture 10, which uses the locating member 4 to lock the waterproof gasket 3 to the lamp holder 1, avoiding falling of the waterproof gasket 3 during replacement of the lamp bulb 5 and effectively sealing the front lamp bulb socket 11 of the lamp holder 1 against outside moisture.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A waterproof outdoor lighting fixture, comprising:

a lamp holder comprising a front lamp bulb socket for receiving a lamp bulb, and a plurality of electrode plates backwardly extended from a rear side of said front lamp bulb socket in a parallel manner;

an outer shell molded on the periphery of said lamp holder, said outer shell comprising a body portion surrounding said lamp holder and a lampshade portion forwardly extended from one end of said body portion and shaped like a horn, and a plurality of locating holes located on an inner wall of said lampshade portion;

a waterproof gasket tightly press-fitted into said lampshade portion of said outer shell and stopped against said lamp holder, said waterproof gasket comprising a center hole cut through opposite front and back sides thereof; and a locating member fastened to said lampshade portion of said outer shell to lock said waterproof gasket, said locating member comprising an annular base, a center opening surrounded by said annular base, and a plurality of locating rods transversely outwardly extended from said annular base and respectively engaged into said locating holes of said outer shell.

2. The waterproof outdoor lighting fixture as claimed in claim 1, wherein said locating rod comprises a beveled guide face.

3. The waterproof outdoor lighting fixture as claimed in claim 1, wherein said outer shell further comprises a tubular rear guard portion backwardly extended from an opposite end of said body portion and spaced around said electrode plates of said lamp holder.

4. The waterproof outdoor lighting fixture as claimed in claim 1, further comprising a power cable said power cable comprising an electrical plug for electrically connecting to a power source, and an electrical socket for receiving said electrode plates of said lamp holder electrically.

5. The waterproof outdoor lighting fixture as claimed in claim 4, wherein said power cable further comprises a hinged seal cap for closing said electrical socket in a watertight manner.

6. The waterproof outdoor lighting fixture as claimed in claim 4, wherein said power cable further comprises a connection block located on a bottom side of said electrical socket, and an anchor member connected to said connection block for anchoring, said anchor member comprising a shank, a pointed pin axially extended from one end of said shank for fastening to the ground, and a connector located on an opposite end of said shank and pivotally adjustably connected to said connection block.

* * * * *